US005507972A

United States Patent [19]

Bauer et al.

[11] Patent Number: 5,507,972

[45] Date of Patent: Apr. 16, 1996

[54] PROCESS FOR THE PREPARATION OF A MIXTURE OF SODIUM SILICATES AND OTHER SALTS AND THE USE OF THE MIXTURE

[75] Inventors: Harald Bauer, Flörsheim; Günther Schimmel, Erftstadt, both of Germany

[73] Assignee: Hoechst AG, Frankfurt am Main, Germany

[21] Appl. No.: 286,744

[22] Filed: Aug. 5, 1994

[30] Foreign Application Priority Data

Aug. 19, 1993 [DE] Germany ..... 43 27 884.1

[51] Int. Cl.[6] ..... C11D 3/02; C11D 7/02

[52] U.S. Cl. ..... 252/174.25; 252/95; 252/99; 252/186.27; 252/186.43; 423/415.2; 423/332

[58] Field of Search ..... 252/95, 99, 186.27, 252/186.43, 174.25; 423/415.2, 332

[56] References Cited

U.S. PATENT DOCUMENTS

| | | | |
|---|---|---|---|
| 4,664,839 | 4/1987 | Rieck | 252/175 |
| 4,950,310 | 8/1990 | Rieck et al. | 34/295 R |
| 5,066,415 | 11/1991 | Dany et al. | 252/135 |
| 5,078,895 | 1/1992 | Dany et al. | 252/94 |
| 5,266,587 | 11/1993 | Sankey et al. | 514/417 |
| 5,294,427 | 3/1994 | Sasaki et al. | 423/415.2 |

*Primary Examiner*—Paul Lieberman
*Assistant Examiner*—Gregory R. Delcotto
*Attorney, Agent, or Firm*—Connolly & Hutz

[57] ABSTRACT

To prepare a mixture of sodium silicates having lamellar structure and sodium carbonate peroxohydrate, sodium silicate composed essentially of $\delta$-$Na_2Si_2O_5$ is reacted at least partially with carbon dioxide and atomized water with continuous circulation with the formation of a kanemite/sodium hydrogen carbonate mixture. The kanemite/sodium hydrogen carbonate mixture and further sodium silicate composed essentially of $\delta$-$Na_2Si_2O_5$ is brought into contact with atomized water with continuous circulation. Finally, 0.015 to 1.5 mol of hydrogen peroxide per mole of sodium silicate composed essentially of $\delta$-$Na_2Si_2O_5$ employed is added to the resulting kanemite/sodium carbonate mixture.

10 Claims, No Drawings

PROCESS FOR THE PREPARATION OF A MIXTURE OF SODIUM SILICATES AND OTHER SALTS AND THE USE OF THE MIXTURE

The present invention relates to a process for the preparation of a mixture of sodium silicates having lamellar structure and sodium carbonate peroxohydrate and the use of this mixture.

Modern detergents are composed of several substances which fulfill various functions. Thus, builders are used for the removal of the natural water hardness in the washing liquor, surfactants for the removal of dirt, and bleaching systems, which are protected by stabilizers, for the oxidative destruction of dirt and germs.

According to U.S. Pat. No. 4,664,839, a detergent and cleaning agent can contain crystalline lamellar sodium silicate, for example the $\delta$-$Na_2Si_2)_5$ similar to the mineral natrosilite. From the $\delta$-$Na_2Si_2O_5$, a further lamellar silicate of the composition $NaHSi_2O_4(OH)_2 \cdot xH_2O$ is accessible, the crystal form containing 2 mol of water corresponding to the naturally occurring kanemite (instead of $NaHSi_2O_4(OH)_2$ the formula $NaHSi_2O_5 \cdot H_2O$ is also often used).

Kanemite can be dehydrated by heating:

$$NaHSi_2O_4(OH)_2 \cdot 2H_2O \rightarrow NaHSi_2O_4(OH)_2 + 2H_2O$$

Further heating leads to elimination of the OH groups:

$$NaHSi_2O_4(OH)_2 \rightarrow NaHSi_2O_5 + H_2O$$

The sodium carbonate peroxohydrate (sodium percarbonate) known as a bleaching agent or oxidant exhibits a good bleaching power at elevated temperature or in the presence of a bleaching activator, while it neither attacks nor turns yellow animal or synthetic fibers or those treated with optical brighteners.

The previously unpublished German Patent Application P 42 23 546.4 discloses a process for the preparation of a mixture of sodium silicates and a further salt, in which sodium silicate composed essentially of $\delta$-$Na_2Si_2O_5$ is reacted with carbon dioxide and hydrogen peroxide solution is added to the reaction product. The resulting mixture is evaporated either under reduced pressure or by spraying it into a warm gas stream and the solid residue is subsequently dried A disadvantage of the known process is that it is relatively laborious and that the yield of hydrogen peroxide, based on the mixture, is low.

The object of the present invention is therefore to give details of a simple process for the preparation of a mixture of lamellar silicates and sodium carbonate peroxohydrate, in which the added hydrogen peroxide is to the greatest possible extent contained in the mixture. This is achieved according to the invention by a) reacting sodium silicate composed essentially of $\delta$-$Na_2Si_2O_5$ at least partially with carbon dioxide and atomized water with continuous circulation with the formation of a kanemite/sodium hydrogen carbonate mixture, b) bringing the kanemite/sodium hydrogen carbonate mixture as in a) and further sodium silicate composed essentially of $\delta$-$Na_2Si_2O_5$ into contact with atomized water with continuous circulation and c) adding 0.015 to 1.5 mol of hydrogen peroxide per mol of sodium silicate composed essentially of $\delta$-$Na_2Si_2O_5$ employed to the kanemite/sodium carbonate mixture as in b).

The process according to the invention can furthermore alternatively be arranged such that:

aa) the reaction as in a) is carried out at temperatures from 20° to 70°;

bb) the kanemite/sodium carbonate mixture obtained as in b) is dried at temperatures from 20° to 150° C., preferably from 70° to 130° C.;

cc) the addition of the hydrogen peroxide is carried out at temperatures from 10° to 120° C., preferably from 20° to 50° C.;

dd) the mixture as in c) is dried at temperatures from 20° to 150° C.;

ee) the drying is carried out in vacuo;

ff) the drying is carried out in the gas stream.

Finally, the mixture prepared by the process according to the invention can be used as a composition for washing, cleaning and/or bleaching.

In the process according to the invention, the first step proceeds as in the equation $$\delta\text{-}Na_2Si_2O_5 + CO_2 + yH_2O \rightarrow NaHSi_2O_4(OH)_2 \cdot xH_2O + NaHCO_3$$

while in the second step the kanemite/sodium hydrogen carbonate mixture formed is further reacted in the sense of a comproportionation in the absence of carbon dioxide with finely dispersed water, the sodium silicates composed essentially of $\delta$-$Na_2Si_2O_5$ required for this either being added extra or, in the case of substoichiometric use of carbon dioxide in the first step, being left over in this step.

Surprisingly, the solid-state reaction between $\delta$-$Na_2Si_2O_5$ and sodium hydrogen carbonate proceeds completely in the process according to the invention; the reaction products are clearly characterizable by X-ray diffraction analysis.

In the process according to the invention, the content of sodium hydrogen carbonate, sodium carbonate and kanemite and lastly also the content of sodium carbonate peroxohydrate in the mixture can vary over the amount of sodium silicate composed essentially of $\delta$-$Na_2Si_2O_5$ employed in the second step:

$$NaHSi_2O_4(OH)_2 \cdot xH_2O + NaHCO_3 + \delta\text{-}Na_2Si_2O_5 + zH_2O \rightarrow 2NaHSi_2O_4(OH)_2 \cdot xH_2O + Na_2CO_3$$

In the process according to the invention, the product of the second step can be treated with hydrogen peroxide either in dried or in undried form, the amount of hydrogen peroxide being fitted to the desired peroxide content of the mixture.

In the process according to the invention, other substances which are advantageous in the use of the mixture, such as magnesium salts, salts of ethylenediaminetetraacetic acid and ethylenediaminetetramethylenephosphonic acid, salts of phosphoric and polyphosphoric acids and also sodium tetraborate, can be added in all three steps. It is particularly advantageous to add these substances to the hydrogen peroxide before its use.

In the process according to the invention, it is particularly advantageous that the two solid-state reactions, namely the first step up to the end point kanemite/sodium hydrogen carbonate and the second step reverse reaction kanemite/sodium carbonate, proceed completely at low temperatures, as a result of which a defined mixture is obtainable with a high hydrogen peroxide yield and without waste water being produced.

For the following examples, a rotary evaporator (type Rotadest R50 from QVF) having a volume of 50 1 was used as the reactor, the distillation bulb being provided with an attachment which had inlet tubes for gas and liquid and a sampling tube for gases. Liquid was metered with the aid of a membrane pump (type GFK from PROMINENT) and atomized in the distillation bulb using an ultrasonic atomizer (type US-1 from LECHLER). The distillation bulb could be filled and emptied via a side fitting. For temperature control, the distillation bulb was situated in a heatable water bath.

EXAMPLE 1 (comparison example)

550 g of sodium silicate composed essentially of $\delta$-$Na_2Si_2O_5$ (type SKS-6 from HOECHST AG) were poured into the dry distillation bulb of the rotary evaporator and its side fitting was closed. The distillation bulb rotating at 30 rpm was blanketed for 15 minutes with carbon dioxide (3 $m^3/h$) and heated to an internal temperature of 50° C. With the aid of the metering pump, 830 g of hydrogen peroxide (70% by weight) were metered in in the course of 4.5 hours (7 g/min), the internal temperature being kept at 50° C. because of the exothermic reaction.

5980 g of a dry, granular product were obtained. Its analytical data were: Weight loss at 150° C.:

16.96% ($\hat{=}$8.57% $H_2O$)

$H_2O_2$ content: 7.39%

$H_2O_2$ yield: 35% pH of a 1% strength aqueous solution at 20° C.: 11.0

EXAMPLE 2 (according to the invention)

660 g of sodium silicate composed essentially of $\delta$-$Na_2Si_2O_5$ (type SKS-6 from HOECHST AG) were poured into the dry distillation bulb of the rotary evaporator and its side fitting was closed. The distillation bulb rotating at 30 rpm was blanketed for 12 minutes with carbon dioxide (0.26 $m^3/h$) and heated to an internal temperature of 50° C. In a stream of carbon dioxide, 428 g of deionized water were introduced into the distillation bulb in the course of 70 minutes with the aid of the metering pump and ultrasonic atomizer. After displacing the carbon dioxide from the distillation bulb with nitrogen, a further 1160 g of sodium silicate composed essentially of $\delta$-$Na_2Si_2O_5$ were poured into the distillation bulb via its side fitting. Without further addition of gas, a further 250 g of water were atomized in the distillation bulb in the course of 45 minutes, before a 3-hour predrying in a stream of nitrogen (0.6 to 2 $m^3/h$) was carried out at an internal temperature of 70° to 80° C. The material in the distillation bulb was then taken out via its side fitting and dried at 110° for 3 days in flat dishes in a recirculated air drying oven.

The dried material was introduced into the distillation bulb again and treated with 484 g of hydrogen peroxide (70% by weight) at an internal temperature of 50° C. in the course of 100 minutes with rotation in a stream of nitrogen (0.6 $m^3/h$). After increasing the flow of nitrogen to 12 $m^3/h$ the material taken out of the distillation bulb was additionally dried for 2 hours before being dried at 50° C. for 15 hours in a vacuum drying oven.

2120 g of granular product were obtained which, according to the X-ray diffractogram, contained Na-SKS-9 (compare U.S. Pat. No. 4,664,839, column 7, lines 36 to 50), with the following analytical data: Weight loss at 150° C.: 14.37 %

($\hat{=}$5.56% $H_2O$)

$H_2o_2$ content: 8.81%

$H_2O_2$ yield: 55% pH of a 1% strength aqueous solution at 20° C.: 11.4

EXAMPLE 3 (according to the invention)

660 g of sodium silicate composed essentially of $\delta$-$Na_2Si_2O_5$ (type SKS-6 from HOECHST AG) were poured into the dry distillation bulb of the rotary evaporator and its side fitting was closed. The distillation bulb rotating at 30 rpm was blanketed for 12 minutes with carbon dioxide (0.26 $m^3/h$) and heated to an internal temperature of 50° C. In a stream of carbon dioxide, 428 g of deionized water were introduced into the distillation bulb in the course of 23 minutes with the aid of metering pump and ultrasonic atomizer. After displacing the carbon dioxide from the distillation bulb with nitrogen (0.6 $m^3/h$, 5 minutes), a further 1160 g of sodium silicate composed essentially of $\delta$-$Na_2Si_2O_5$ were introduced into the distillation bulb via its side fitting. Without further addition of gas, a further 250 g of water were atomized in the distillation bulb in the course of 17 minutes After cooling the reaction mixture to 25° C. 484 g of hydrogen peroxide (70 % by weight) were added in the course of 26 minutes with cooling and a nitrogen flow of 0.6 $m^3/h$. The material was taken out of the distillation bulb via its side fitting and dried at an air inlet temperature of 95° to 105° C. in a universal rapid dryer (type TG1 from RETSCH) in six batches of about 500 g each for 30 minutes in each case.

2390 g of granular product having the following analytical data were obtained: Weight loss at 150° C.: 16.13%

($\hat{=}$8.07% $H_2O$)

$H_2O$ a content: 8.06%

$H_2O_2$ yield: 57% pH of a 1% strength aqueous solution at 20° C.: 11.2

EXAMPLE 4 (according to the invention)

1820 g of sodium silicate composed essentially of $_6$-$Na_2Si_2O_5$ (type SKS-6 from HOECHST AG) were poured into the dry distillation bulb of the rotary evaporator and its side fitting was closed. The distillation bulb rotating at 30 rpm was blanketed for 12 minutes with carbon dioxide (0.26 $m^3/h$) and heated to an internal temperature of 50° C. In a stream of carbon dioxide, 360 g of deionized water were introduced into the distillation bulb in the course of 23 minutes with the aid of metering pump and ultrasonic atomizer. After displacing the carbon dioxide from the distillation bulb with nitrogen (0.6 $m^3/h$, 5 minutes), a further 318 g of water were atomized in the distillation bulb without further addition of gas in the course of 22 minutes. After cooling the reaction mixture to 25° C., 484 g of hydrogen peroxide (70% by weight) were added in the course of 26 minutes with cooling and a nitrogen flow of 0.6 $m^3/h$. The material was taken out of the distillation bulb via its side fitting and dried at an air inlet temperature of 95° to 105° C. in a universal rapid dryer (type TG1 from RETSCH) in six batches of about 500 g each for 30 minutes in each case.

2180 g of granular product having the following analytical data were obtained: Weight loss at 150° C.: 16.31%

($\hat{=}$8.41% H20)

$H_2O_2$ content: 7.90%

$H_2O_2$ yield: 51% pH of a 1% strength aqueous solution at 20° C: 11.1

The most important data of the products obtained according to the above examples are compiled in the table.

TABLE

| | | Examples | | | |
|---|---|---|---|---|---|
| | | 1 | 2 | 3 | 4 |
| Na silicate | (g) | 4450 | 1820 | 1820 | 1820 |
| Water | (g) | — | 678 | 678 | 678 |
| $H_2O_2$ (70% strength) | (g) | 1830 | 484 | 484 | 484 |
| $CO_2$ | (g) | about 28000 | about 710 | about 300 | about 300 |
| Product mass | (g) | 5980 | 2120 | 2390 | 2180 |
| $H_2O_2$ content | (% by weight) | 7.39 | 8.81 | 8.06 | 7.90 |
| $H_2O_2$ yield | (%) | 35 | 55 | 57 | 51 |

We claim:

1. A process for the preparation of a mixture of sodium silicates having lamellar structure and sodium carbonate peroxohydrate which comprises a) reacting sodium silicate composed essentially of $\delta$-$Na_2Si_2O_5$ at least partially with carbon dioxide and atomized water with continuous circulation with the formation of a kanemite/sodium hydrogen carbonate mixture, b) bringing the kanemite/sodium hydrogen carbonate mixture from step a) and further sodium silicate composed essentially of $\delta$-$Na_2Si_2O_5$ into contact with atomized water with continuous circulation and c) adding 0,015 to 1.5 mol of hydrogen peroxide per mol of sodium silicate composed essentially of $\delta$-$Na_2Si_2O_5$ employed to the kanemite/sodium carbonate mixture as in b).

2. The process as claimed in claim 1, wherein the reaction step a) is carried out at temperatures from 20° to 70° C.

3. The process as claimed in claim 1, wherein the kanemite/sodium carbonate mixture obtained in b) is dried at temperatures from 20° to 150° C.

4. The process as claimed in claim 3, wherein the drying is carried out at 70° to 130° C.

5. The process as claimed in claim 1, wherein the addition of the hydrogen peroxide is carried out at temperatures from 10° to 120° C.

6. The process as claimed in claim 1, wherein the addition of the hydrogen peroxide is carried out at temperatures from 20° to 50° C.

7. The process as claimed in claim 1, wherein the mixture as in c) is dried at temperatures from 20° to 50° C.

8. The process as claimed in claim 7, wherein the drying is carried out in vacuo.

9. The process as claimed in claim 7, wherein the drying is carried out in a stream of gas.

10. A composition for washing, cleaning or bleaching, prepared by the process as claimed in claim 1.

* * * * *